US007654015B2

(12) United States Patent
Nakayama

(10) Patent No.: US 7,654,015 B2
(45) Date of Patent: Feb. 2, 2010

(54) BOWLING SHOES WITH INTERCHANGEABLE HEELS

(75) Inventor: Kenji Nakayama, Tokyo (JP)

(73) Assignee: Storm Products, Inc., Brigham City, UT (US)

( * ) Notice: Subject to any disclaimer, the term of this patent is extended or adjusted under 35 U.S.C. 154(b) by 576 days.

(21) Appl. No.: 11/375,384

(22) Filed: Mar. 13, 2006

(65) Prior Publication Data

US 2007/0000152 A1 Jan. 4, 2007

Related U.S. Application Data

(60) Provisional application No. 60/660,716, filed on Mar. 11, 2005.

(51) Int. Cl.
*A43B 5/00* (2006.01)
*A43B 21/36* (2006.01)

(52) U.S. Cl. ..... 36/130; 36/15; 36/42

(58) Field of Classification Search ..... 36/15, 36/100, 130, 42
See application file for complete search history.

(56) References Cited

U.S. PATENT DOCUMENTS

| | | | | |
|---|---|---|---|---|
| 1,542,174 | A * | 6/1925 | Robidoux | 36/15 |
| 2,806,302 | A * | 9/1957 | Sharpe | 36/36 R |
| 3,027,661 | A * | 4/1962 | McCord | 36/30 R |
| 3,318,026 | A * | 5/1967 | Antelo | 36/42 |
| 4,610,100 | A * | 9/1986 | Rhodes | 36/42 |
| 5,058,290 | A * | 10/1991 | Koehl et al. | 36/42 |
| 5,133,138 | A * | 7/1992 | Durcho | 36/36 R |
| 5,542,198 | A * | 8/1996 | Famolare | 36/130 |
| 5,970,630 | A * | 10/1999 | Gallegos | 36/100 |
| 6,243,973 | B1 * | 6/2001 | Lind | 36/130 |
| 6,598,324 | B1 * | 7/2003 | Tsuji | 36/130 |
| 7,246,453 | B2 * | 7/2007 | Kim | 36/15 |
| 7,500,324 | B1 * | 3/2009 | Power et al. | 36/132 |
| 2006/0021260 | A1 * | 2/2006 | Kim | 36/130 |

FOREIGN PATENT DOCUMENTS

| | | |
|---|---|---|
| JP | 2005-087250 | 4/2005 |
| WO | WO 9108685 A1 * | 6/1991 |

OTHER PUBLICATIONS

English Translation of Japanese Patent Application, application No. 2003-321092 filed Sep. 12, 2003, publication No. 2005-087250 published Apr. 7, 2005.

* cited by examiner

*Primary Examiner*—Marie Patterson
(74) *Attorney, Agent, or Firm*—TraskBritt

(57) ABSTRACT

A shoe with a removable and interchangeable heel that may be removably secured to a heel region of a shoe sole, thus, allowing a user to adjust a way the shoe engages a ground surface. The shoe includes an attachment system for removably securing the removable and interchangeable heel to the heel region of the shoe sole, the attachment system comprising a magnetic fastener between the removable and interchangeable heel and the heel region of the shoe sole.

15 Claims, 5 Drawing Sheets

BOWLING SHOES WITH INTERCHANGEABLE HEELS

CROSS-REFERENCE TO RELATED APPLICATION

This application claims benefit from U.S. Provisional Application No. 60/660,716, filed on Mar. 11, 2005, which is incorporated in its entirety herein by reference.

BACKGROUND OF THE INVENTION

1. Field of the Invention

The present invention relates generally to shoes. In particular, the present invention relates to bowling shoes that allow the user adjust the way their bowling shoes engage a bowling surface depending on the bowling surface conditions and the bowler's individual style.

2. State of the Art

Generally, when a bowler approaches the bowling lane to throw the bowling ball down the bowling lane, the foot opposite the bowler's throwing hand performs a sliding function and the other foot performs a kicking function. For a right-handed bowler, the left-foot performs the slide function and the right-foot performs the kicking function. The sliding function of the bowler's foot can affect the bowler's ball control and power. Additionally, the condition of the bowling lanes, lane approaches, room temperature and humidity will influence the sliding function and the bowler's performance. As such, bowlers would benefit from the ability to adjust the way their bowling shoes engage the bowling surface depending on the bowling surface conditions and the bowler's individual style.

One disadvantage of a bowling shoe with a fixed sole is the inability to get the best sliding function under changing bowling surface conditions. Furthermore, fixed-sole bowling shoes make it necessary for the bowler to have many pairs of bowling shoes in order to be prepared for different bowling surface conditions.

Different bowling shoe designs have been developed which allow the bowler to adjust the friction of the shoe by changing the tread surface of the sole of the shoe, including the toe portion, the heel portion and the center, or arch, portions of the sole. The tread surface of the sole is changed by using removable slide parts that attach to the bottom surface of the sole with adhesive tape, interlocking hook and pile loop fasteners and other fasteners. However, the use of these fasteners allows the removable slide parts to move and, thus, compromises the stability of the bowling shoe. Moreover, the movement of the slide parts and instability of the bowling shoe decreases the durability and life of the bowling shoe, particularly of the heel portion of shoe which bears the greatest weight.

Accordingly, there is a need for bowling shoes that allow the user to change the friction of the shoe sole on the bowling surface that also have increased stability and durability.

BRIEF SUMMARY OF THE INVENTION

The present invention includes a bowling shoe that has various options for adjustment or customization by featuring a plurality of removable and interchangeable heels with a predetermined frictional characteristic that is freely put on or off the heel region of the shoe sole. The removable and interchangeable heel may be removably secured to the heel region of the shoe sole using a magnetic fastener between the removable and interchangeable heel and the heel region of the shoe sole. The magnetic fastener may be such that the interchangeable heel may be freely removed from the heel region of the shoe sole. The magnetic fastener may include a first magnet or magnetic material on a shoe-sole-facing surface of the heel and a second magnet or magnetic material on the heel region of the shoe sole, wherein the first and second magnet or magnetic materials are magnetically attracted to each other sufficiently to removably secure together the heel region of the shoe sole and the desired removable and interchangeable heel. Magnetic materials that may be used with embodiments of the invention may include materials that are magnetizable or are magnetically attracted to a magnetized material, such as iron or steel.

The bowling shoe of the instant invention may comprise a shoe upper and a shoe sole mounted to the shoe upper. The shoe sole may have a tread surface extending longitudinally, continuously or intermittently, from a toe end of the shoe sole rearward to an arch portion thereof. The shoe may further comprise a removable and interchangeable heel that may be freely put on or off the heel region of the shoe sole. The removable and interchangeable heel includes a shoe-sole-facing surface and a ground-touching tread surface. The ground-touching tread surface may include a predetermined frictional characteristic, and may also include a perimeter substantially congruent with an outer perimeter of the heel region of the shoe sole.

The shoe may also include a heel region of the shoe sole with a cut out or indention formed centrally in the heel region of the shoe sole or the cut out or indention may be formed longitudinally or laterally across at least a partial width of the heel region of the shoe sole. Moreover, the cut out or indention may be configured to secure therein a magnet or magnetic material. Furthermore, the cut out or indention may be formed to accept at least a portion of a magnet or magnetic material that is attached to the shoe-sole-facing surface of a removable and interchangeable heel.

Embodiments of the invention may also provide a removable and interchangeable heel that may be freely put on or off the heel region of the sole of a shoe. The removable and interchangeable heel may have a shoe-sole-facing surface and a ground-touching tread surface. The ground-touching tread surface may have a predetermined frictional characteristic and may be manufactured from, or partially or completely covered with materials such as natural or synthetic rubber, leather, felt, foam, silicone or other materials that may affect the friction and sliding performance of the shoe. The removable and interchangeable heel can be removably secured to the heel region of the shoe sole with an attachment system including one or more magnetic fasteners between the removable and interchangeable heel and the heel region of the shoe sole, the one or more magnetic fasteners configured such that the interchangeable heel may be freely removed from the heel region of the shoe sole.

The present invention may also provide a method of adjusting the friction and sliding performance of a bowling shoe sole on the bowling lane approach surface. The method may comprise providing a shoe with interchangeable heels, wherein the shoe includes a shoe upper and a shoe sole mounted to the shoe upper. The shoe sole may have a tread surface at the forward portion of the sole extending continuously or intermittently, from a toe end of the shoe sole rearward to an arch portion thereof. The shoe sole may also have a heel region at a rear portion of the shoe sole. The shoe may further feature a plurality of removable and interchangeable heels that may be freely put on or off the heel region of the shoe sole. The removable and interchangeable heels may each have a shoe-sole-facing surface and a ground-touching tread surface and a perimeter substantially congruent with an outer perimeter of the heel region of the shoe sole. The ground-touching tread surface of the plurality of removable and interchangeable heels may each have a predetermined frictional characteristic and may each be manufactured from, or partially or completely covered with materials such as natural or synthetic rubber, leather, felt, foam, silicone or other materials that may affect the friction and sliding performance of a bowling shoe sole on the bowling lane approach surface. The removable and interchangeable heels may be removably secured to the heel region of the sole by means of an attachment system including one or more magnetic fasteners between the removable and interchangeable heel and the heel region of the shoe sole, the one or more magnetic fasteners configured such that the removable and interchangeable heels may be freely removed from the heel region of the shoe sole. The attachment system may also include other known fastening techniques such as hook and pile loop fasteners that facilitate interchangeability. A magnetic fastener may comprise a first magnet or magnetic material on a shoe-sole-facing surface of the heel and a second magnet or magnetic material on the heel region of the shoe sole, wherein the first and second magnet or magnetic materials are magnetically attracted to each other sufficiently to removably secure together the heel region of the shoe sole and the removable and interchangeable heel. The method further comprises selecting one removable and interchangeable heel from the plurality of removable and interchangeable heels and removably securing the selected one removable and interchangeable heel to the heel region of the shoe sole and then placing the shoe on the foot opposite the bowling ball throwing hand, thus, adjusting the friction of the bowling shoe sole on the bowling lane approach and achieving the desired sliding performance.

Other features and advantages of the present invention will become apparent to those of ordinary skill in the art through consideration of the ensuing description, the accompanying drawings, and the appended claims.

BRIEF DESCRIPTION OF THE SEVERAL VIEWS OF THE DRAWINGS

In the drawings, which illustrate exemplary embodiments of various aspects of the present invention.

DETAILED DESCRIPTION OF THE INVENTION

Figure 1:
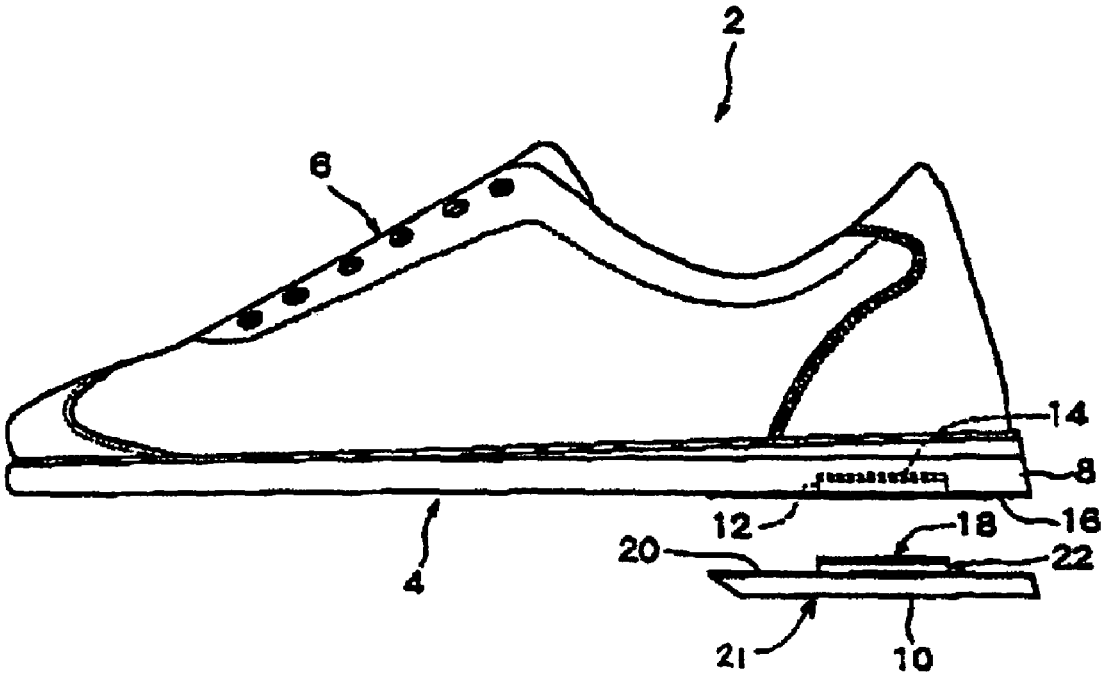
FIG. 1 illustrates a side view of a construction of a shoe and a removable and interchangeable heel according to embodiments of the present invention.
Figure 2:
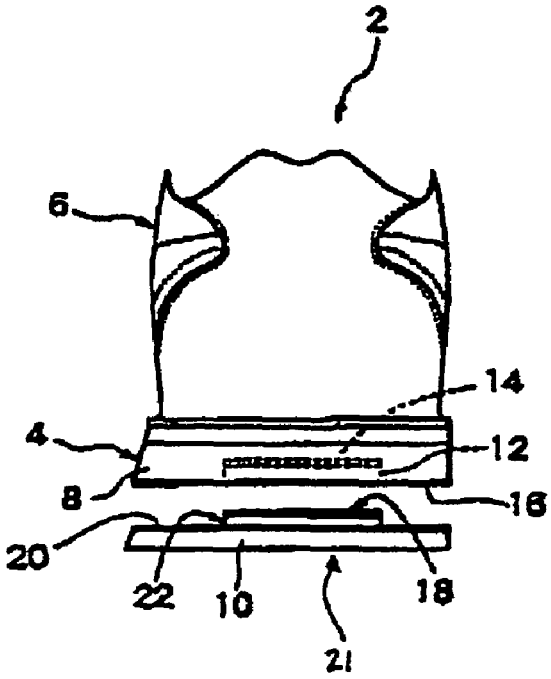
FIG. 2 illustrates a rear view of a construction of a shoe and a removable and interchangeable heel according to embodiments of the present invention.

An exemplary embodiment of the present invention is shown FIGS. 1-5. In FIGS. 1 and 2, the bowling shoe 2 is depicted with a shoe upper 6 and a shoe sole 4 mounted to the shoe upper 6. The shoe sole 4 having a heel region 8. The shoe upper 6 may be made from natural or synthetic materials, or combinations thereof, including leather, synthetic leather, canvas, nylon and vinyl. The shoe sole 4 may be made from natural and/or synthetic materials such as leather, plastic, synthetic or natural rubber, etc.

Figure 3:
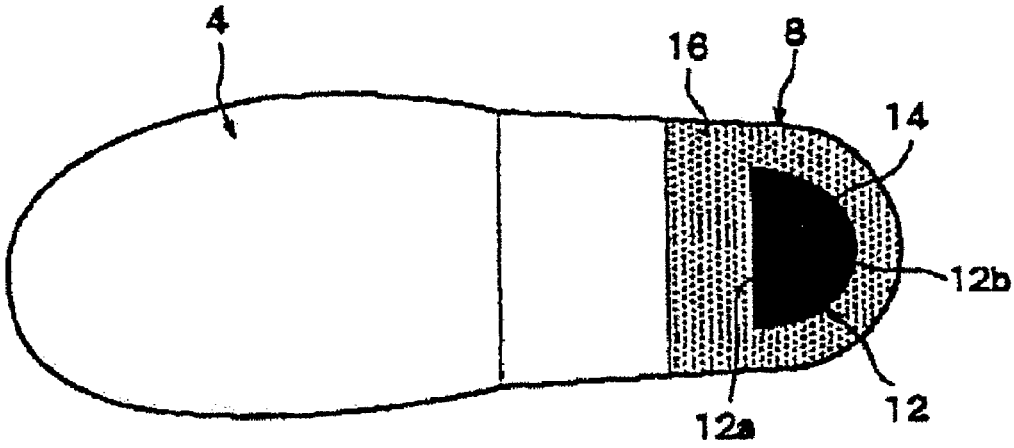
FIG. 3 illustrates a bottom view of a sole of the shoe shown in FIGS. 1 and 2.

The cut out or indention 12 in the heel region 8 of the shoe sole 4 may be centrally located and configured to accept a sole magnet or magnetic material 14 (FIGS. 1 and 2). The sole magnet or magnetic material 14 may be secured to the bottom of the cut out or indention 12 and configured to fit within the boundaries defined by the edges 12*a* and 12*b* of the cut out or indention 12 such that a face of the magnet or magnetic material 14 is substantially parallel with the bottom of the cut out or indention 12. The cut out or indention 12 may be configured as shown in FIG. 3 with edge 12*a* and edge 12*b* having a shape and a depth configured to accommodate the sole magnet or magnetic material 14. The cut out or indention 12 may also be configured in other desired shapes and depths. Moreover, the cut out or indention 12 may be configured with a depth and shape to receive the depth and shape of the heel magnet or magnetic material 18 as it is attached to the shoe-sole-facing surface 20 of the removable and interchangeable heel 10 (FIGS. 1 and 2). As known by those of skill in the art, the magnet or magnetic materials used as the sole magnet or magnetic materials 14 or heel magnet or magnetic materials 18 may include materials that are magnetizable or are magnetically attracted to a magnetized material such as iron or steel.

The removable and interchangeable heel 10 may have a shoe-sole-facing surface 20 and a ground-touching tread surface 21 (FIGS. 1 and 2). The removable and interchangeable heel 10 may have a predetermined frictional characteristic and may be constructed of materials such as natural or synthetic rubber, leather, felt, foam, silicone or other materials that affect the friction and sliding performance of the bowling shoe 2. Alternatively, the ground-touching tread surface 21 may be partially or completely covered with materials such as natural or synthetic rubber, leather, felt, foam, silicone or other materials that affect the friction and sliding performance of the bowling shoe 2.

The removable and interchangeable heel 10 may be removably secured to the heel region 8 of the shoe sole 4 by aligning the heel magnet or magnetic material 18 attached to the removable and interchangeable heel 10 with the cut out or indention 12 in the heel region 8 (FIG. 11) and sole magnet or magnetic material 14 therein. As such, the sole and heel magnets or magnetic materials 14 and 18, respectively, may be brought into sufficient proximity to allow a magnetic attraction between the sole and heel magnets or magnetic materials 14 and 18, thus, removably securing the removable and interchangeable heel 10 to the heel region 8 of the shoe sole 4.

Figure 5:
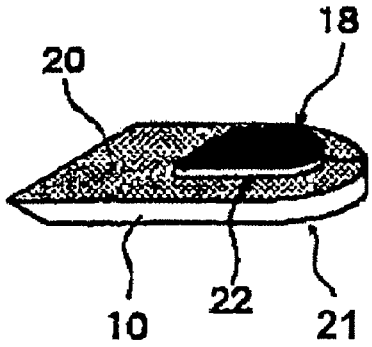
FIG. 5 illustrates a perspective view of the removable and interchangeable heel shown in FIGS. 1 and 2.
Figure 11:
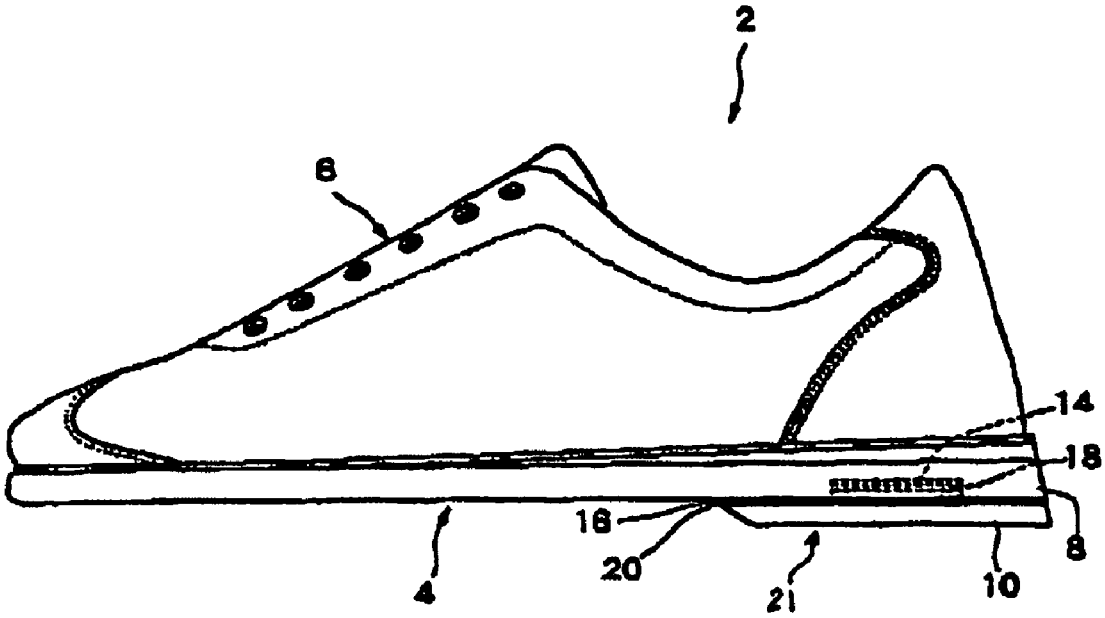
FIG. 11 illustrates a side view of a construction of a shoe and a removable and interchangeable heel according to embodiments of the present invention.

The heel magnet or magnetic material 18 may be secured to base plate 22 which is secured to the shoe-sole-facing surface 20 of the removable and interchangeable heel 10 (FIG. 5). In this case, the heel magnet or magnetic material 18 and the base plate 22 are inserted into the cut out or indention 12 in the heel region 8 (FIGS. 1 and 11).

Figure 4:
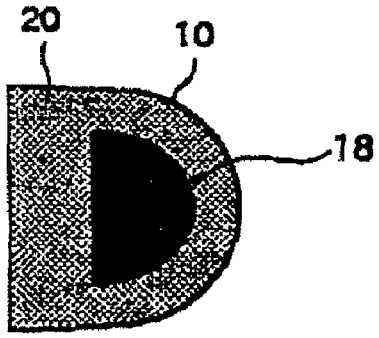
FIG. 4 illustrates a view of a shoe-sole-facing surface of the removable and interchangeable heel shown in FIGS. 1 and 2.

Additionally, the shoe-sole-facing surface 20 and the bottom surface 16 (see also FIGS. 1 and 2) of the heel region 8, not including the surfaces defined by the cut out or indention 12 and the heel magnet or magnetic material 18, may have hook and pile loop fasteners attached thereon to help removably secure the removable and interchangeable heel 10 to the heel region 8 of the shoe sole 4 (FIGS. 3-5).

The sole and heel magnets or magnetic materials 14 and 18, respectively, may be made of a magnetized metal or out of a flexible rubber magnet or other suitable magnets or magnetic materials known in the art that allow a sufficient magnetic attraction between the sole and heel magnets or magnetic materials 14 and 18 to removably secure the removable and interchangeable heel 10 to the heel region 8 of the shoe sole 4.

Figure 6:
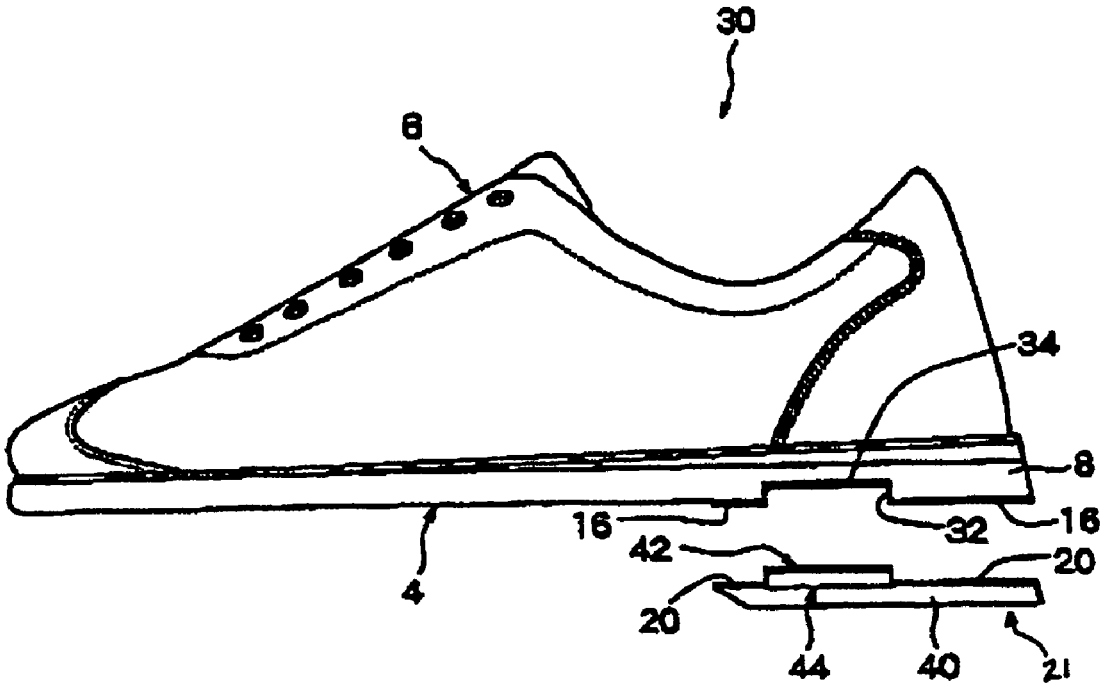
FIG. 6 illustrates a side view of a construction of a shoe and a removable and interchangeable heel according to particular embodiments of the present invention.
Figure 7:
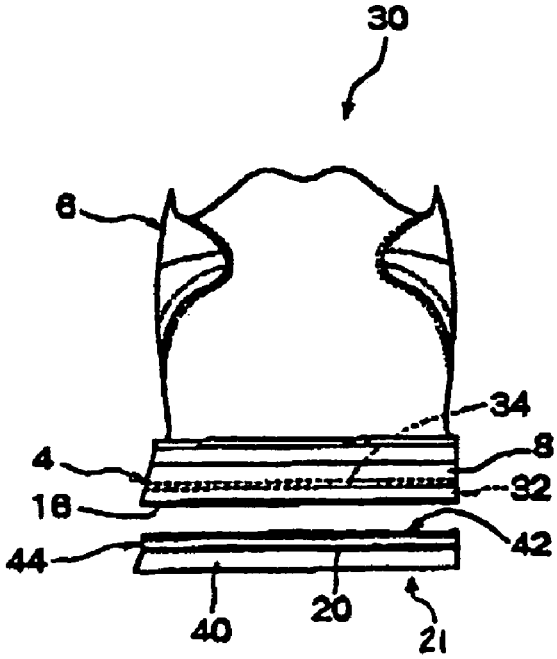
FIG. 7 illustrates a rear view of a construction of a shoe and a removable and interchangeable heel according to particular embodiments of the present invention.

An exemplary embodiment of the present invention is also shown FIGS. 6-10. In FIGS. 6 and 7, a bowling shoe 30 is depicted with a shoe upper 6 and a shoe sole 4 mounted to the shoe upper 6. The shoe sole 4 is depicted as having a heel region 8. The shoe upper 6 may be made from natural and synthetic materials, or combinations thereof, including leather, synthetic leather, canvas, nylon and vinyl. The shoe sole 4 may be made from natural and/or synthetic materials such as leather, plastic, synthetic or natural rubber, etc.

Figure 8:
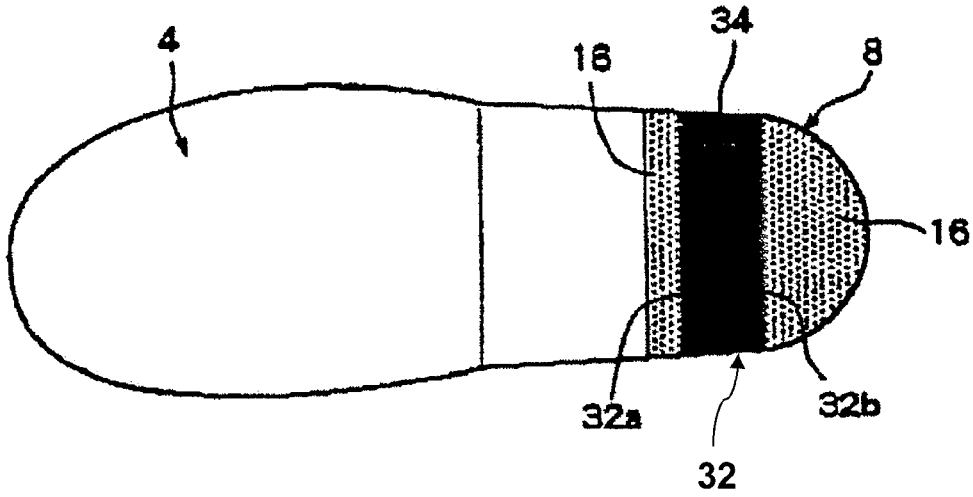
FIG. 8 illustrates a bottom view of a sole of the shoe shown in FIGS. 6 and 7.

The cut out or indention 32 in the heel region 8 of the shoe sole 4 may be laterally located across the entire width of the heel region 8 and configured to accept a magnet or magnetic material 34 (FIGS. 6 and 7). The magnet or magnetic material 34 may be secured to the bottom of the cut out or indention 32 and configured to fit within the boundaries defined by the edges 32*a* and 32*b* of the cut out or indention 32 such that a face of the magnet or magnetic material 34 is substantially parallel with the bottom of the cut out or indention 32 (see also FIG. 8). The cut out or indention 32 may be configured as shown in FIG. 8 with edge 32*a* and edge 32*b* with a shape and a depth configured to accommodate the magnet or magnetic material 34. The cut out or indention 32 may also be configured longitudinally and/or laterally across a partial or entire width of the heel region 8. Moreover, the cut out or indention 32 may be configured with a depth and shape to receive a depth and shape of a heel magnet or magnetic material 42 as it is attached to the shoe-sole-facing surface 20 of the removable and interchangeable heel 40 (FIGS. 6 and 7).

Figure 10:
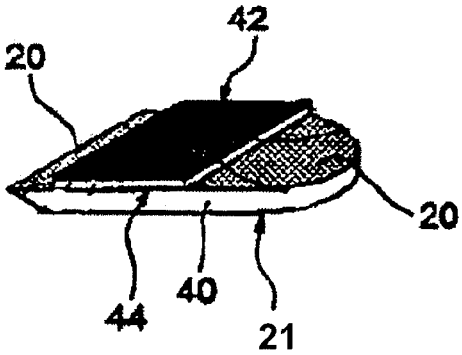
FIG. 10 illustrates a perspective view of the removable and interchangeable heel shown in FIGS. 6 and 7.

The removable and interchangeable heel 40 may have a shoe-sole-facing surface 20 and a ground-touching tread surface 21 (FIG. 10). The removable and interchangeable heel 40 may be constructed of materials such as natural or synthetic rubber, leather, felt, foam, silicone or other materials that affect the friction and sliding performance of the bowling shoe 30. Moreover, the ground-touching tread surface 21 may have a predetermined frictional characteristic and may be partially or completely covered with materials such as natural or synthetic rubber, leather, felt, foam, silicone or other materials that affect the friction and sliding performance of the shoe.

Figure 12:
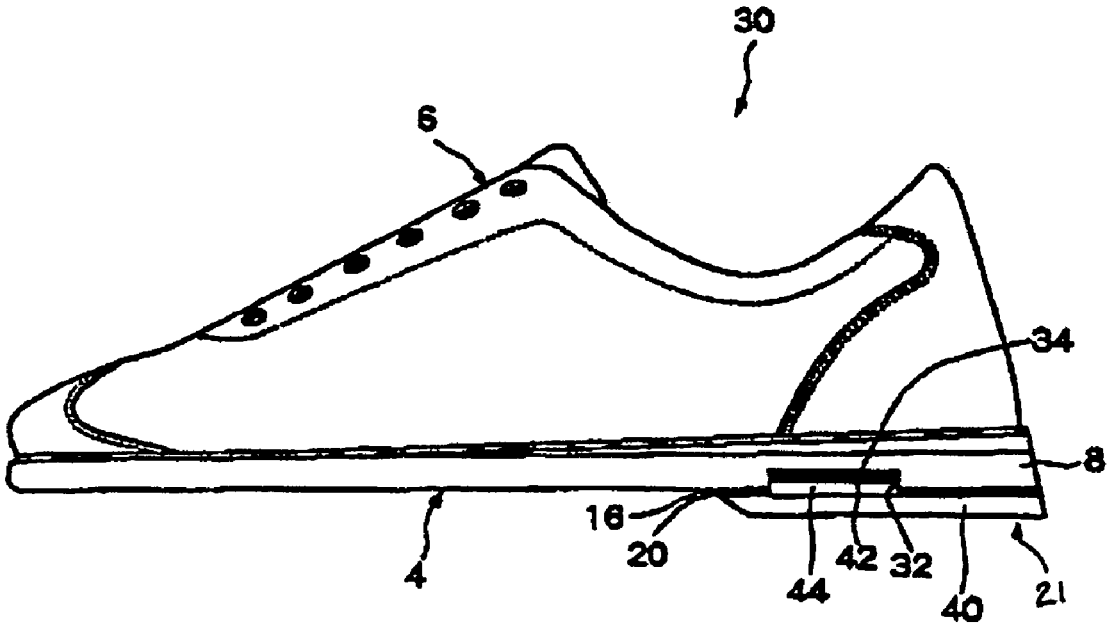
FIG. 12 illustrates a side view of a construction of a shoe and a removable and interchangeable heel according to embodiments of the present invention.

The removable and interchangeable heel 40 may be removably secured to the heel region 8 of the shoe sole 4 by aligning the heel magnet or magnetic material 42 attached to the removable and interchangeable heel 40 with the cut out or indention 32 in the heel region 8 (FIG. 12). As such, the magnet or magnetic material 34 and heel magnet or magnetic material 42 may be brought into sufficient proximity to allow a magnetic attraction between the magnets or magnetic materials 34 and 42, thus, removably securing the removable and interchangeable heel 40 to the heel region 8 of the shoe sole 4.

The heel magnet or magnetic material 42 may be secured to base plate 44 which is secured to the shoe-sole-facing surface 20 of the removable and interchangeable heel 40 (FIG. 10). In this case, the heel magnet or magnetic material 42 and the base plate 44 are inserted into the cut out or indention 32 in the heel region 8 (FIGS. 6 and 12).

Figure 9:
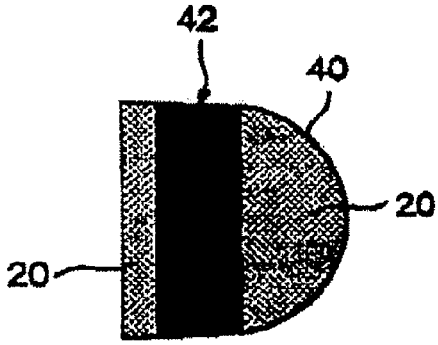
FIG. 9 illustrates a view of a shoe-sole-facing surface of the removable and interchangeable heel shown in FIGS. 6 and 7.

Additionally, the shoe-sole-facing surface 20 and the bottom surface 16 of the heel region 8, not including the surfaces defined by the cut out or indention 32 and the heel magnet or magnetic material 42, may have hook and pile loop fasteners attached thereon to help removably secure the removable and interchangeable heel 40 to the heel region 8 of the shoe sole 4 (FIGS. 8-10).

The magnets or magnetic materials 34 and 42 may be made of a magnetized metal or out of a flexible rubber magnet or other suitable magnets or magnetic materials known in the art that allow a sufficient magnetic attraction between the magnets or magnetic materials 34 and 42 to removably secure the removable and interchangeable heel 10 to the heel region 8 of the shoe sole 4.

The removable and interchangeable heel 40 may also be removably secured to the heel region 8 of the shoe sole 4 with a cut out or indention on the shoe-sole-facing surface 20 of the removable and interchangeable heel 40, with a magnet or magnetic material therein, the cut out or indention configured to accept a magnet or magnetic material attached on the heel region 8 of the shoe sole 4.

Also, the removable and interchangeable heel 40 may be removably secured to the heel region 8 of the shoe sole 4 by a sliding fastener configured much like a dovetail joint and including a beveled lateral channel within the heel region 8 of the shoe sole 4, or a beveled lateral channel formed within the shoe-sole-facing surface 20 of the removable and interchangeable heel 40. The channel configured to accept a beveled lateral extension is located on the heel region 8 of the shoe sole 4 or located on the shoe-sole-facing surface 20 of the removable and interchangeable heel 40. The beveled lateral extension is configured to slide within the beveled lateral channel much like a dovetail joint, thus removably securing the removable and interchangeable heel 40 to the heel region 8 of the shoe sole 4.

According to other embodiments of the invention, methods for adjusting the friction and/or sliding performance of a bowling shoe are provided. In some embodiments, the sliding performance of a bowling shoe may be adjusted by interchanging an interchangeable heel portion of the bowling shoe with a second interchangeable heel portion to provide improved sliding performance with a bowling surface in contact with the bowling shoe. In other embodiments, the friction between a bowling shoe and a bowling surface may be improved by interchanging an interchangeable heel portion of the bowling shoe with a second interchangeable heel portion to provide improved friction between the second interchangeable heel portion and a bowling surface.

Although the foregoing description contains many specific examples, these examples should not be construed as limiting the scope of the present invention, but merely as providing illustrations of some exemplary embodiments. Similarly, other embodiments of the invention may be devised which do not depart form the spirit or scope of the present invention. Features from different embodiments may be employed in combination. The scope of the invention is, therefore, indicated and limited only by the appended claims and their legal equivalents, rather than by the foregoing description. All additions, deletions and modifications to the invention, as disclosed herein which fall within the meaning and scope of the claims are to be embraced thereby.

What is claimed is:

1. A shoe with a removable and interchangeable heel, the shoe comprising:

a shoe upper and a shoe sole mounted to the shoe upper, wherein the shoe sole comprises a tread surface extending, continuously or intermittently, from a toe end of the shoe sole rearward to an arch portion thereof and a heel region at a rear portion of the shoe sole;

a removable and interchangeable heel removably secured to the heel region of the shoe sole, wherein the removable and interchangeable heel comprises a shoe-sole-facing surface and a ground-touching tread surface; and attachment means for removably securing the removable and interchangeable heel to the heel region of the shoe sole, the attachment means comprising a magnetic fastener including a magnet or magnetic material between the removable and interchangeable heel and the heel region of the shoe sole;

wherein the heel region of the shoe sole comprises an indention, wherein the indention is configured to secure therein a magnet or magnetic material and configured to accept at least a portion of a magnet or magnetic material that is attached to the shoe-sole-facing surface of the removable and interchangeable heel.

2. The shoe of claim 1, wherein the magnetic fastener comprises a first magnet or magnetic material attached to the shoe-sole-facing surface of the removable and interchangeable heel and a second magnet or magnetic material attached to the heel region of the shoe sole, wherein the first and second magnets or magnetic materials are magnetically attracted to each other sufficiently to removably secure together the heel region of the shoe sole and the removable and interchangeable heel.

3. The magnetic fastener of claim 2, further comprising a sliding fastener configured like a dovetail joint including a channel located on the heel region of the shoe sole, wherein the channel is configured to accept an extension, wherein the extension is located on the shoe-sole-facing surface of the removable and interchangeable heel, wherein the extension is configured to slide within the channel substantially like a dovetail joint, thus removably securing the removable and interchangeable heel to the heel region of the shoe sole.

4. The shoe of claim 1, wherein the indention is formed centrally in the heel region of the shoe sole.

5. The shoe of claim 1, wherein the indention is formed laterally and/or longitudinally across the heel region of the shoe sole.

6. The shoe of claim 1, wherein the attachment means further comprises hook and pile loop fasteners.

7. The shoe of claim 1, wherein the ground-touching tread surface of the removable and interchangeable heel has a predetermined frictional characteristic and is constructed of materials selected from the group consisting of natural rubber, synthetic rubber, leather, felt, foam, silicone, plastic or combinations thereof.

8. The shoe of claim 1, wherein the ground-touching tread surface of the removable and interchangeable heel has a predetermined frictional characteristic and is at least partially covered with materials selected from the group consisting of natural rubber, synthetic rubber, leather, felt, foam, silicone, plastic or combinations thereof.

9. A method of adjusting the friction and sliding performance of a bowling shoe on a bowling lane approach surface, the method comprising:

providing a shoe including a shoe upper and a shoe sole mounted to the shoe upper, the shoe sole including a tread surface at a forward portion of the shoe sole extending, continuously or intermittently, from a toe end of the shoe sole rearward to an arch portion thereof and a heel region at a rear portion of the shoe sole, the shoe sole further comprising an indention in the heel region thereof;

providing a plurality of removable and interchangeable heels that may be freely put on or off the heel region of the shoe sole, wherein each of the plurality of removable and interchangeable heels have a shoe-sole-facing surface and a ground-touching tread surface with a predetermined frictional characteristic;

receiving at least a portion of at least one of the plurality of removable and interchangeable heels within the indention in the heel region of the shoe sole;

removably securing the at least one of the plurality of removable and interchangeable heels to the heel region of the shoe sole by means of an attachment system comprising a magnet or magnetic material creating a magnetic fastener between the at least one of the plurality of removable and interchangeable heels and the heel region of the shoe sole; and placing the bowling shoe with the selected removable and interchangeable heel on a foot opposite the bowling ball throwing hand, thus, adjusting the friction of the bowling shoe on the bowling lane approach and achieving a desired sliding performance.

10. The method of claim 9, further comprising:

affixing a first magnet or magnetic material on the shoe-sole-facing surface of the removable and interchangeable heel and a second magnet or magnetic material on the heel region of the shoe sole; and magnetically attracting the first and second magnets or magnetic materials to each other sufficiently to removably secure together the heel region of the shoe sole and the removable and interchangeable heel.

11. The method of claim 9, further comprising:

centrally forming the indention in the heel region of the shoe sole;

securing a magnet or magnetic material within the indention; and accepting at least a portion of a magnet or magnetic material that is attached to the shoe-sole-facing surface of the removable and interchangeable heel within the indention.

12. The method of claim 9, further comprising:

forming the indention in the heel region of the shoe sole laterally and/or longitudinally across the heel region of the shoe sole;

securing a magnet or magnetic material in the indention; and accepting at least a portion of a magnet or magnetic material that is attached to the shoe-sole-facing surface of the at least a portion of at least one of the plurality of removable and interchangeable heels within the indention.

13. The method of claim 9, further comprising removably securing the heel region of the shoe sole with hook and pile loop fasteners.

14. The method of claim 9, further comprising:

predetermining a frictional characteristic of the ground-touching tread surface of each of the plurality of removable and interchangeable heels; and constructing the plurality of removable and interchangeable heels from materials selected from the group consisting of natural rubber, synthetic rubber, leather, felt, foam, silicone, plastic or combinations thereof.

15. The method of claim 9, further comprising:

predetermining a frictional characteristic of the ground-touching tread surface of each of the plurality of removable and interchangeable heels; and at least partially covering the plurality of removable and interchangeable heels with materials selected from the group consisting of natural rubber, synthetic rubber, leather, felt, foam, silicone, plastic or combinations thereof.

* * * * *